United States Patent [19]

Hunt

[11] Patent Number: 5,016,577

[45] Date of Patent: May 21, 1991

[54] HEAT EXCHANGER

[76] Inventor: Thomas C. Hunt, P.O. Box 369, Bainbridge, Ind. 46105

[21] Appl. No.: 510,113

[22] Filed: Apr. 17, 1990

[51] Int. Cl.[5] ..... F22B 7/12

[52] U.S. Cl. ..... 122/182.1; 122/1 A; 122/16; 122/121; 165/173

[58] Field of Search ..... 122/182 S, 16, 178, 122/179, 121, 128, 182 R, 48, 116, 1 A; 165/173

[56] References Cited

U.S. PATENT DOCUMENTS

| | | | |
|---|---|---|---|
| 978,769 | 12/1910 | Massie | 122/182 S |
| 1,684,201 | 9/1928 | Pollock | 122/182 S |
| 4,157,078 | 6/1979 | Ostbo | 122/182 S |

*Primary Examiner*—Edward G. Favors
*Attorney, Agent, or Firm*—Woodard, Emhardt, Naughton, Moriarty & McNett

[57] ABSTRACT

A heat exchanger assembly for a paint baking booth includes a horizontal cylindrical fire box with a vertical cylindrical hot gas riser chamber atop the fire box. A tube mounting plate across and sealed to the the top of the riser chamber extends outwardly from it. There is an array of circularly spaced fire tubes. Each tube has an entrance at the bottom of the mounting plate inside the top of the riser chamber, and extends upwardly and outwardly therefrom and then downwardly along side the riser chamber and then further outwardly and then upwardly parallel to the downward extending portion and then inwardly and upwardly into a stack for exhaust to the exterior of the building. A circular array of water tubes extends downward from inside the stack and through the top plate of the riser chamber into the chamber for exposure to hot combustion gases, and then upward and out through the plate and into the stack and horizontally out from the stack to provide heated water for use in space heaters or for other purposes.

15 Claims, 4 Drawing Sheets

HEAT EXCHANGER

BACKGROUND OF THE INVENTION

1. Field of the Invention

This invention relates generally to heat exchangers and more particularly to a heat exchanger assembly particularly useful where rapid heating of significant quantities of air for space heating purposes is needed, such as in paint spray and baking booths.

2. Description of the Prior Art

Paint booths are provided with air that is heated by an indirect fired or direct fired system. In direct fired systems, the heated air may include combustion products. In the indirect fired system, the combustion products are handled separately, and heat exchangers of conventional types are used. When the outdoor air temperature is low, below 30 degrees F., the indirect fired systems known to me do not have the ability to provide sufficient temperature rise when handling the needed volume of air to achieve the desired spray booth temperatures. It is desirable to expedite the temperature rise in a higher volume of air without significant increase in firing rate. My invention is directed toward achieving this result.

SUMMARY OF THE INVENTION

Described briefly, according to a typical embodiment of the present invention, a heat exchanger assembly includes a fire box, a chamber rising from the fire box and having a plate across the top and extending outwardly therefrom. An array of fire tubes is employed, each having an entrance at the top of the riser chamber, and extending outwardly therefrom and downwardly along side the riser chamber and then further outwardly and then upwardly parallel to the downward extending portion and then inwardly and upwardly into a stack for exhaust to the exterior of the building. A circular array of water tubes extends downward from inside the stack and through the top plate of the riser chamber into the chamber for exposure to hot combustion gases and then upward and out through the plate and into the stack and horizontally out from the stack to provide heated water for use in space heaters or for other purposes.

DESCRIPTION OF THE PREFERRED EMBODIMENT

Figure 1:
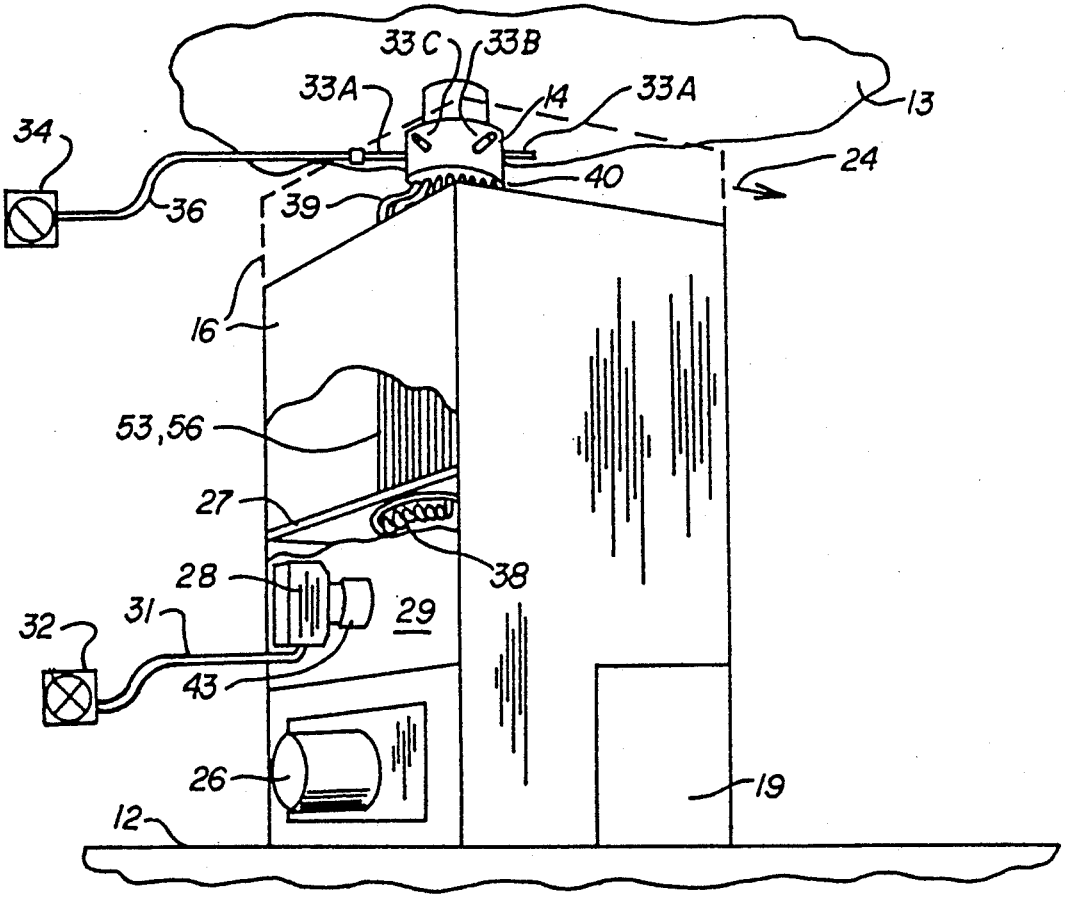
FIG. 1 is a pictorial view of a portion of an air supply system for a paint spray and bake booth and incorporating the present invention.

For the purposes of promoting an understanding of the principles of the invention, reference will now be made to the embodiment illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

Referring now to the drawings in detail and particularly FIG. 1, the equipment is shown on the floor 12 of a room having ceiling 13 with a combustion product vent stack 14 extending through the ceiling to the outdoors. The heat exchanger tubing is within a plenum 16 (upper portion dotted to show where plenum upper side and top panels are omitted to show part of the heat exchanger features) to which air is supplied upward by a blower driven by a motor 26 to pull air in through opening 19 and drive it up through the heat exchanger and discharge out from the far side of the plenum 16 at 24 into appropriate duct work to a paint baking booth (not shown). A gas fired burner assembly 28 is mounted to a panel 29 extending co-planar with the front panel of plenum 16. It is supplied by fuel gas through a line 31 from a source 32. An array of six water tube ends 33 (four of which are shown) extends radially from the stack 14. At least three of these are inlets supplied from a water supply source 34 through pipes such as 36 for a purpose which will be described. The other three are exits through the stack for supplying water heated heat exchangers for space heating or other purposes in the building, if desired. The heat exchanger of the present invention, and which is different from the aforementioned space heating heat exchangers, includes a plurality of vertically extending tubes 53 and 56 in the plenum 16 and which have U-shaped portions 38 extending below the plate 27 and which have generally inwardly converging portions 39 in the upper (dotted) portion of the plenum 16 and entering the stack 14 at the stack bottom plate 40.

Figure 2:
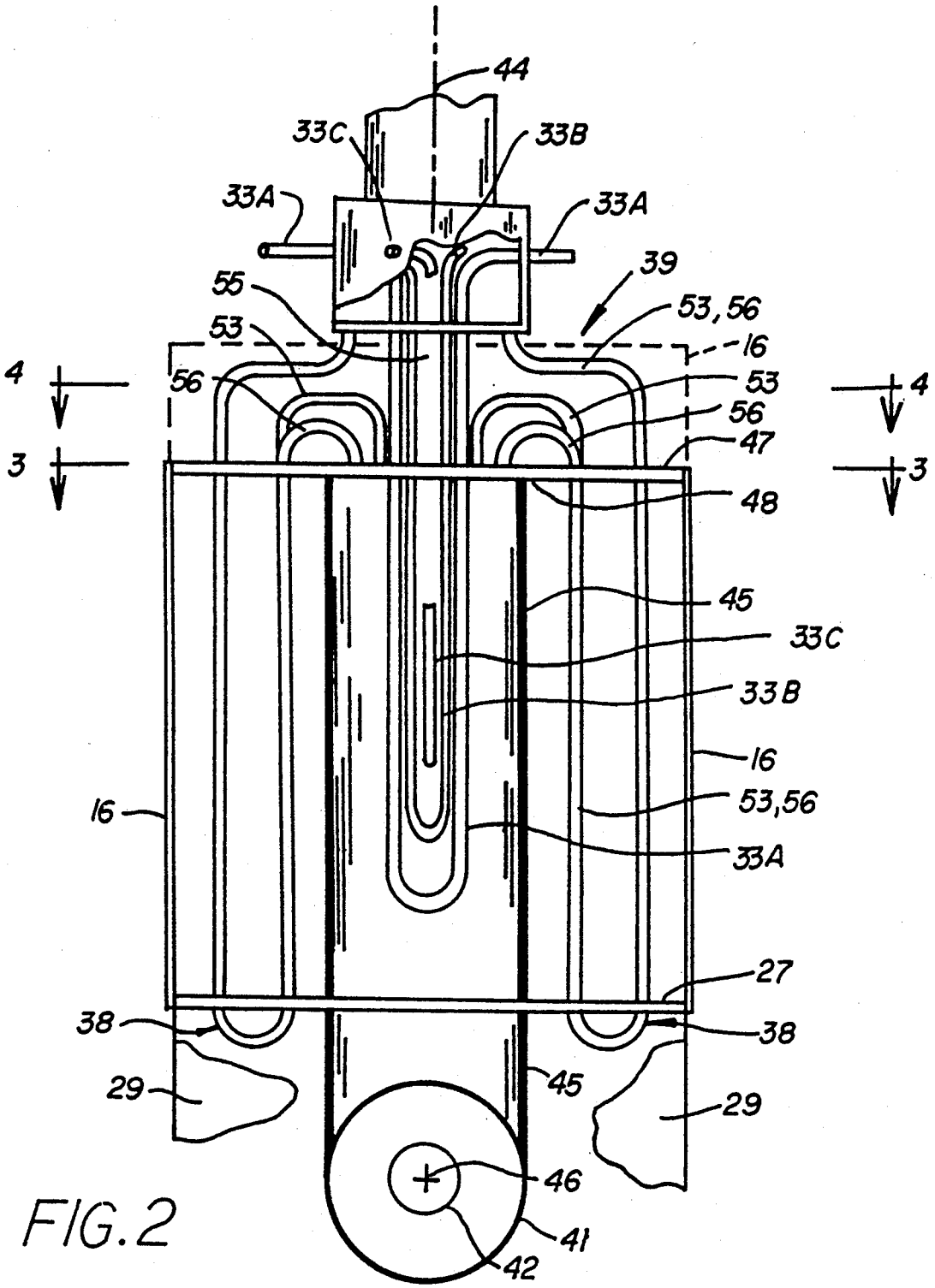
FIG. 2 is a vertical section through the heat exchanger assembly.
Figure 3:
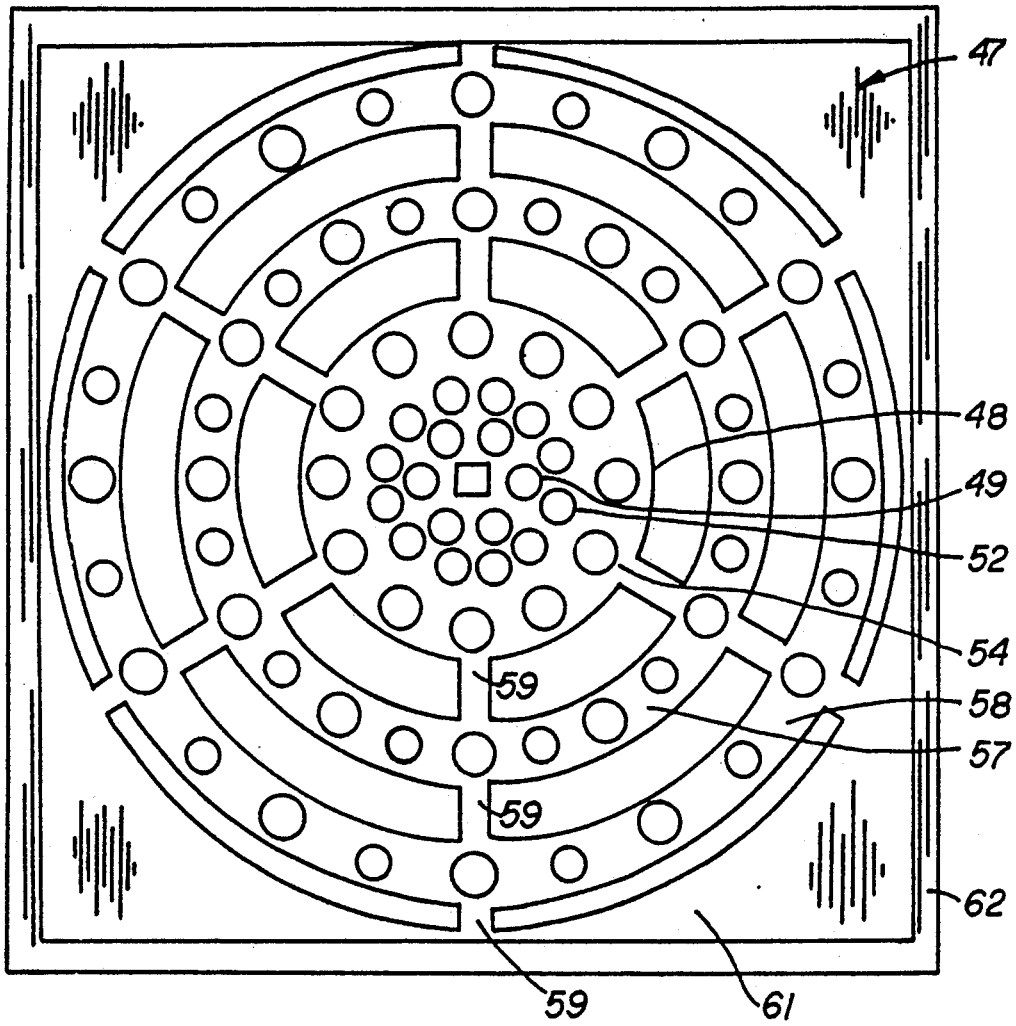
FIG. 3 is a section taken at line 3—3 in FIG. 2 and viewed in the direction of the arrows.

Referring now to FIGS. 2 and 3, the plenum 16 is shown with the panel 29 below it. A cylindrical fire box 41 has the front end opening 42 which receives the burner tube 43 (FIG. 1). A cylindrical riser 45 is welded to the top of the fire box 41 and extends vertically upward, with the vertical axis 44 of the riser intersecting the central axis 46 of the fire box.

A fire tube upper mounting plate 47 is welded to the top of the riser 45 around a circle 48 in FIG. 3. This plate has five circles of circularly spaced holes in it. The first circle of holes 49, having six holes in it, is for water tubes 33A, 33B and 33C. The second circle of holes 52 having twelve holes in it is for 1.5 inch diameter fire tubes 53 FIG. 4. The third circle of holes 54 having twelve holes in it is for 2 inch diameter fire tubes 56. The fourth circle of holes is in ring 57 having twenty-four holes in it for the fire tubes 53 and 56 as they go down along side the riser cylinder 45 to the fire tube lower mounting plate 27. The fifth circle of holes is in ring 58 having twenty-four holes in it for the upwardly extending fire tube portions 53 and 56 as they extend up through it.

As shown in the drawing, the fire tube holes in the circles are of two different sizes. Holes 52 in the second circle are 1.5 inch diameter. Holes 54 in the third circle are two inches in diameter. The holes in the rings 57 and 58 are both sizes to respectively handle the two different sizes of fire tubes. The rings 57 and 58 are supported by spokes 59 extending from the center portion to the outer edges and corners 61, and the whole unit may be mounted and sealed in a rectangular frame 62 affixed and sealed to the plenum walls on all four sides such as at 16. The square tube at the center of plates 40 and 47 is for the condensate tube 55 (FIG. 2).

As shown in FIG. 2, each of the fire tubes begins with an entrance on the bottom surface of the plate 47 and extends upwardly and outwardly in an inverted U-shape configuration and down through one of the holes in the ring 57 of plate 47 and then downwardly parallel to the axis 44 and through a hole in the plate 27 and then around and outwardly in a U-shaped configuration and up through a hole in a ring of plate 27 identical to the ring above it in plate 47 and then up parallel to the axis 44 and up through a hole in the ring 58 in plate 47. From there the tube extends upwardly and inwardly and into a hole in the stack bottom plate 40 where it ends. Thus, the exit of each of the fire tubes is at the top of plate 40 from which the exhaust passes up through the stack and out through the roof of the building. The organization of holes in plate 40 is the same as that portion of plate 47 inside circle 48.

Figure 4:
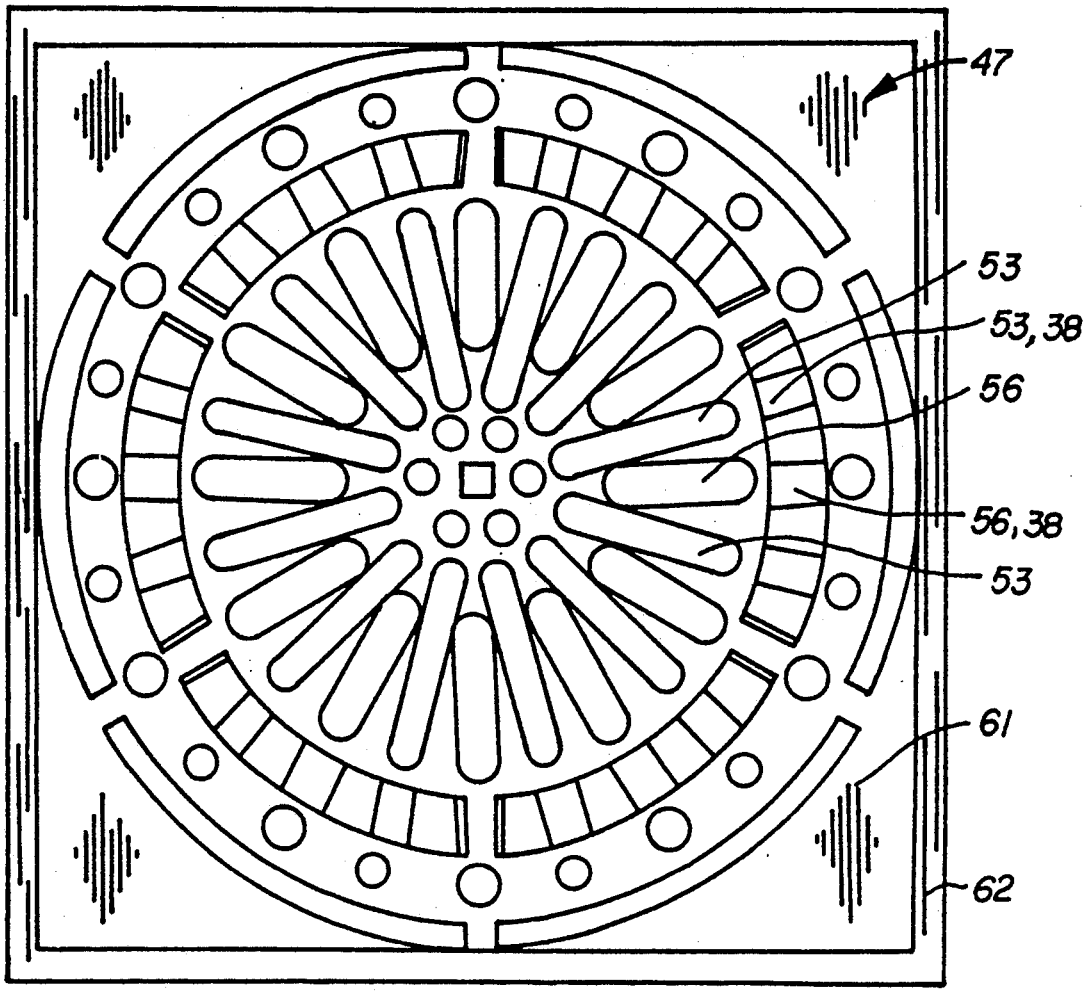
FIG. 4 is a section taken at line 4—4 in FIG. 2 and viewed in the direction of the arrows.

The arrangement of the tubes is as shown in FIG. 4, with the smaller tubes extending from holes 52 in the second ring out to holes of the same size in the fourth ring 57 and then downward. The larger tubes extend from the larger holes 54 which are in the third circle and out to holes of the same size in the fourth ring 57.

The holes are arranged on radial lines at 15° between each other. The arrangement of the tubes to the holes above plate 47 is radial from axis 44 as shown in FIG. 4. Holes and rings are provided in plate 27 according to the same organization as in rings 57 and 58 of plate 47 except that there is a large hole in the center of plate 27 for the riser tube and which is entirely open. Thus, there are only the two rings of holes identical to rings 57 and 58. The four sides of plate 27 are sealed to the plenum wall. In FIG. 4, the radial orientation relative to axis 44, of tube portions 38 of tubes 53 and 56 between the holes of plate 27 corresponding to those in rings 57 and 58 of plate 47 can be seen through the circular air flow slots in plates 47 and 27. Due to the location of the cutting plane 4—4 in FIG. 2 the tube portions 39 converging in from the fifth ring to the stack bottom plate 40 are not shown, but they are radial with respect to axis 44.

The water tubes are continuous tubes. For example, there are three tubes, each of which has a U-shaped bend at the bottom. The three tubes extend from outside the stack as shown at 33A, 33B and 33C in FIG. 1, into the interior of the stack and down through the stack and through holes 49 in the inner ring in plate 47 and down through a substantial portion of the riser tube 43 and then turn upwardly and pass up through a diametrically opposite hole 49 in the plate 47 and up through a similar hole in plate 40 and then out through the wall of the stack at a diametrically opposite location as for water tube 33A in FIG. 2.

In the practice of the invention, steel construction, preferably stainless, may be used. The air is driven upward through the plenum 16 and the heat exchanger, passing around the fire tubes and then out as at 24 into the duct work to the booth. The burner may be a variable firing rate gas burner, if desired. Water would be passed continually through the water tubes during operation of the burner.

The water tubes can be connected through appropriate valving equipment to water chilling equipment for summer usage during painting operations in a booth for climate control in the booth and the building.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected.

What is claimed is:

1. A heat exchanger assembly comprising:

a fire box;

a first combustion chamber riser chamber having a vertically oriented longitudinal axis and located above the fire box and communicating with the fire box for delivering combustion products upward out of the fire box;

a first plurality of exhaust gas passageways in a radially extending circular array around the riser chamber, each passageway having an entrance at the top of the riser chamber and extending from the entrance upward and then radially outward relative to the axis and then downward and then outward relative to the axis and then upward and then inward toward the axis and then upward generally parallel to the axis to exhaust.

2. The assembly of claim 1 and wherein:

the portions of the passageways extending downward extend generally alongside the riser chamber.

3. The assembly of claim 2 wherein:

the portions of the passageways extending generally alongside the riser chamber extend generally parallel to the longitudinal axis of the riser chamber.

4. The assembly of claim 3 wherein:

the riser chamber has a top and a bottom; and the portions of the passageways extending downward generally alongside the riser chamber extend downward to a level generally corresponding with the level of the bottom of the riser chamber, and the first mentioned portions of the passageways extending upward extend upward to a level generally corresponding with the level of the top of the riser chamber.

5. The assembly of claim 1 and further comprising:

a second plurality of exhaust passageways in an array around the riser chamber, each passageway of the second plurality having an entrance at the top of the riser chamber and extending from the entrance upward and outward relative to the axis and then downward and then outward and then upward and then inward toward the axis and then upward generally parallel to the axis and to a exhaust.

6. The assembly of claim 5 and wherein:

the passageways are provided by tubes; and the tubes of the first plurality are 1½ inch diameter; and the tubes of the second plurality are 2 inch diameter.

7. The assembly of claim 5 and further comprising:

a plurality of water tubes in the riser chamber and extending generally parallel to the axis and circularly spaced from each other around the axis, the water tubes being arranged in pairs at diametrically opposite points in a circle; and connector tubing means at the bottom of each pair for providing communication between the two tubes of a pair for a water flow path down one of the tubes of the pair and through the connector tubing means and up through the other tube of the pair.

8. The assembly of claim 1 and wherein the passageways are provided by tubes, the assembly further comprising:

a plenum around the plurality of tubes to direct air flow around them.

9. The assembly of claim 8 and further comprising:
first and second vertically-spaced tube plates, the first tube plate being fastened to the top of the riser chamber, and the second tube plate being fastened to the bottom of the riser chamber and sealed to the riser chamber,
the tubes being secured to and positioned by the tube plates, and the passageway entrances being located in the first tube plate,
the plenum being sealed to the tube plates.

10. The assembly of claim 9 and further comprising:
an exhaust stack above the first tube plate,
the tubes passing upward into and opening inside the stack.

11. The assembly of claim 10 and further comprising:
a plurality of water tubes extending downward through the first tube plate and into the riser chamber and extending downward in the riser chamber to a location near the bottom of the riser chamber for exposure to hot gases flowing from the combustion chamber upward through the riser chamber,
and the water tubes then turning upward and up through the riser chamber and top plate to the exterior for delivery of hot water therefrom.

12. The assembly of claim 11 and further comprising:
a burner coupled to the fire box; and
a water supply coupled to the water tubes.

13. The assembly of claim 12 and further comprising:
air mover means coupled to the plenum for driving air through the plenum to collect heat from the combustion products flowing through the passageway tubes.

14. The assembly of claim 13 and further comprising:
a source of combustible material coupled to the burner for burning in the fire box.

15. The assembly of claim 9 and wherein:
the plates have pluralities of holes in them to receive the tubes through them, the holes being arranged on radial lines at 15 degree angles between them.

* * * * *